United States Patent [19]

Baltz et al.

[11] Patent Number: 4,747,381

[45] Date of Patent: May 31, 1988

[54] MARINE PROPULSION DEVICE WITH SPARK TIMING AND FUEL SUPPLY CONTROL MECHANISM

[75] Inventors: Gene F. Baltz, Lake Villa, Ill.; Geoffrey S. Zgorzelski, Kenosha, Wis.

[73] Assignee: Outboard Marine Corporation, Waukegan, Ill.

[21] Appl. No.: 91,510

[22] Filed: Aug. 31, 1987

[51] Int. Cl.[4] ..... F02P 5/02

[52] U.S. Cl. ..... 123/413; 440/87

[58] Field of Search ..... 123/395, 400, 403, 413; 440/87

[56] References Cited

U.S. PATENT DOCUMENTS

| | | | |
|---|---|---|---|
| 1,886,566 | 11/1932 | Mallory | 123/413 |
| 2,635,595 | 4/1953 | Raleigh | 123/403 |
| 2,890,689 | 6/1959 | Alexander | 123/334 |
| 2,906,251 | 9/1959 | Soder, Jr. | 123/413 |
| 2,982,275 | 5/1961 | Doman et al. | 123/413 |
| 3,195,529 | 7/1965 | Walker | 123/413 |
| 3,734,069 | 5/1973 | Akiyama et al. | 123/305 |
| 4,492,198 | 1/1985 | Okumura | 123/413 |
| 4,528,953 | 7/1985 | Flaig et al. | 123/413 |
| 4,528,954 | 7/1985 | Slattery | 123/413 |
| 4,566,415 | 1/1986 | Iwai et al. | 123/361 |
| 4,602,602 | 7/1986 | Donohue | 123/413 |
| 4,606,314 | 8/1986 | Yamazaki | 123/413 |
| 4,622,938 | 11/1986 | Wenstadt et al. | 123/413 |
| 4,643,149 | 2/1987 | Dunham | 123/403 |

FOREIGN PATENT DOCUMENTS

| | | | |
|---|---|---|---|
| 0125326 | 9/1979 | Japan | 123/413 |

*Primary Examiner*—Willis R. Wolfe

*Attorney, Agent, or Firm*—Michael, Best & Friedrich

[57] ABSTRACT

A marine propulsion device comprising a propulsion unit including a rotatably mounted propeller, and an engine drivingly connected to the propeller and comprising an engine block, a spark timing mechanism, a fuel supply mechanism, a control lever supported by the engine block, a mechanism for displacing the fuel supply mechanism from an idle setting to a full speed setting in response to movement of the control lever from an idle position to a full speed position, and a spark timing control mechanism for permitting movement of the control lever from the idle position to a first intermediate position without displacing the spark timing mechanism from a minimum spark advance setting, for displacing the spark timing mechanism from the minimum spark advance setting to a maximum spark advance setting in response to movement of the control lever from the first intermediate position to a second intermediate position, and for displacing the spark timing mechanism from the maximum spark advance setting to an intermediate spark advance setting in response to movement of the control lever from the second intermediate position to the full speed position.

22 Claims, 2 Drawing Sheets

MARINE PROPULSION DEVICE WITH SPARK TIMING AND FUEL SUPPLY CONTROL MECHANISM

BACKGROUND OF THE INVENTION

The invention relates generally to marine propulsion devices, such as outboard motors, and to internal combustion engines. In addition, the invention relates to integrated control of the fuel supply and spark timing mechanisms of engines incorporated in outboard motors.

Attention is directed to the following prior art patents:

| | | |
|---|---|---|
| M. Mallory | 1,886,566 | 11/20/29 |
| W. J. Raleigh | 2,635,595 | 05/19/50 |
| C. F. Alexander | 2,890,689 | 04/22/57 |
| D. T. Doman, et al. | 2,982,275 | 11/14/57 |
| Soder | 2,906,251 | 09/29/59 |
| B. Walker | 3,195,529 | 02/13/63 |
| Akiyama, et al. | 3,734,069 | 05/22/73 |
| Okumura | 4,492,198 | 01/08/85 |
| Flaig, et al. | 4,528,953 | 07/16/85 |
| Slattery | 4,528,954 | 07/16/85 |
| Iwai, et al. | 4,566,415 | 01/28/86 |
| Donohue | 4,602,602 | 07/29/86 |
| Yamazaki | 4,606,314 | 08/19/86 |
| Wenstadt, et al. | 4,622,938 | 11/18/86 |
| Dunham | 4,643,149 | 02/17/87 |

Attention is also directed to copending application Ser. No. 066,142, filed June 24, 1987 and assigned to the assignee of the present invention, still pending.

SUMMARY OF THE INVENTION

The invention provides a marine propulsion device comprising a propulsion unit including a rotatably mounted propeller, and an engine drivingly connected to the propeller and comprising an engine block, a spark timing mechanism operable between a minimum spark advance setting and a maximum spark advance setting, a fuel supply mechanism operable between an idle setting and a full speed setting, a control lever supported by the engine block for movement between an idle position, a full speed position, a first intermediate position between the idle position and the full speed position, and a second intermediate position between the first intermediate position and the full speed position, means for displacing the fuel supply mechanism from the idle setting to the full speed setting in response to movement of the control lever from the idle position to the full speed position, and spark timing control means for permitting movement of the control lever from the idle position to the first intermediate position without displacing the spark timing mechanism from the minimum spark advance setting, for displacing the spark timing mechanism from the minimum spark advance setting to the maximum spark advance setting in response to movement of the control lever from the first intermediate position to the second intermediate position, and for displacing the spark timing mechanism from the maximum spark advance setting toward the minimum spark advance setting in response to movement of the control lever from the second intermediate position to the full speed position.

The invention also provides a marine propulsion device comprising a propulsion unit including a rotatably mounted propeller, and an engine drivingly connected to the propeller and comprising an engine block, a spark timing mechanism operable between a minimum spark advance setting, a maximum spark advance setting, and an intermediate spark advance setting between the minimum spark advance setting and the maximum spark advance setting, a fuel supply mechanism operable between an idle setting and a full speed setting, a control lever supported by the engine block for movement between an idle position, a full speed position, a first intermediate position between the idle position and the full speed position, and a second intermediate position between the first intermediate position and the full speed position, means for displacing the fuel supply mechanism from the idle setting to the full speed setting in response to movement of the control lever from the idle position to the full speed position, and spark timing control means for permitting movement of the control lever from the idle position to the first intermediate position without displacing the spark timing mechanism from the minimum spark advance setting, for displacing the spark timing mechanism from the minimum spark advance setting to the maximum spark advance setting in response to movement of the control lever from the first intermediate position to the second intermediate position, and for displacing the spark timing mechanism from the maximum spark advance setting to the intermediate spark advance setting in response to movement of the control lever from the second intermediate position to the full speed position.

In one embodiment, the spark timing control means includes cam and roller means.

In one embodiment, the cam and roller means includes a spark lever supported by the engine block for movement between a minimum position, a maximum position, and an intermediate position between the minimum position and the maximum position, means for biasing the spark lever to the minimum position, means for displacing the spark timing mechanism to the minimum spark advance setting in response to movement of the spark lever to the minimum position, for displacing the spark timing mechanism to the intermediate spark advance setting in response to movement of the spark lever to the intermediate position, and for displacing the spark timing mechanism to the maximum spark advance setting in response to movement of the spark lever to the maximum position, a roller on one of the control lever and the spark lever, and a cam surface on the other of the control lever and the spark lever, the cam surface engaging the roller when the control lever is between the first intermediate position and the full speed position, and the cam surface having a shape such that the spark lever moves from the minimum position to the maximum position in response to movement of the control lever from the first intermediate position to the second intermediate position, and moves from the maximum position to the intermediate position in response to movement of the control lever from the second intermediate position to the full speed position.

In one embodiment, the roller is on the control lever and the cam surface is on the spark lever.

In one embodiment, the device further comprises means for limiting movement of the spark lever in the direction toward the minimum position.

In one embodiment, the device further comprises means for adjusting the setting of the spark timing mechanism relative to the position of the spark lever.

In one embodiment, the cam surface is out of engagemen with the roller when the control lever is between the idle position and the first intermediate position.

In one embodiment, the means for displacing the fuel supply mechanism includes a throttle lever having thereon a cam surface, means for rotating the throttle lever in response to rotation of the control lever, and roller means engaging the cam surface for displacing the fuel supply mechanism in response to rotation of the throttle lever.

In one embodiment, the device further comprises means for limiting movement of the control lever in the direction toward the full speed position.

In one embodiment, the device further comprises means for limiting displacement of the spark timing mechanism in the direction toward the minimum spark advance setting.

The invention also provides an engine comprising an engine block, a spark timing mechanism operable between a minimum spark advance setting and a maximum spark advance setting, a fuel supply mechanism operable between an idle setting and a full speed setting, a control lever supported by the engine block for movement between an idle position, a full speed position, a first intermediate position between the idle position and the full speed position, and a second intermediate position between the firs intermediate position and the full speed position, means for displacing the fuel supply mechanism from the idle setting to the full speed setting in response to movement of the control lever from the idle position to the full speed position, and spark timing control means for permitting movement of the control lever from the idle position to the first intermediate position without displacing the spark timing mechanism from the minimum spark advance setting, for displacing the spark timing mechanism from the minimum spark advance setting to the maximum spark advance setting in response to movement of the control lever from the first intermediate position to the second intermediate position, and for displacing the spark timing mechanism from the maximum spark advance setting toward the minimum spark advance setting in response to movement of the control lever from the second intermediate position to the full speed position.

The invention also provides an engine comprising an engine block, a spark timing mechanism operable between a minimum spark advance setting, a maximum spark advance setting, and an intermediate spark advance setting between the minimum spark advance setting and the maximum spark advance setting, a fuel supply mechanism operable between an idle setting and a full speed setting, a control lever supported by the engine block for movement between an idle position, a full speed position, a first intermediate position between the idle position and the full speed position, and a second intermediate position between the first intermediate position and the full speed position, means for displacing the fuel supply mechanism from the idle setting to the full speed setting in response to movement of the control lever from the idle position to the full speed position, and spark timing control means for permitting movement of the control lever from the idle position to the first intermediate position without displacing the spark timing mechanism from the minimum spark advance setting, for displacing the spark timing mechanism from the minimum spark advance setting to the maximum spark advance setting in response to movement of the control lever from the first intermediate position to the second intermediate position, and for displacing the spark timing mechanism from the maximum spark advance setting to the intermediate spark advance setting in response to movement of the control lever from the second intermediate position to the full speed position.

A principal feature of the invention is the provision of spark timing control means for permitting movement of a control lever from an idle position to a first intermediate position without displacing a spark timing mechanism from a minimum spark advance setting, for displacing the spark timing mechanism from the minimum spark advance setting to a maximum spark advance setting in response to movement of the control lever from the first intermediate position to a second intermediate position, and for displacing the spark timing mechanism from the maximum spark advance setting to an intermediate spark advance setting in response to movement of the control lever from the second intermediate position to a full speed position. The resulting relationship between the fuel supply mechanism or throttle setting and the spark timing mechanism setting provides optimum engine running quality and fuel economy.

Another principal feature of the invention is the provision of cam and roller means for controlling the spark timing mechanism as described above.

Other features and advantages of the invention will become apparent to those skilled in the art upon review of the following detailed description, claims and drawings.

Figure 1:
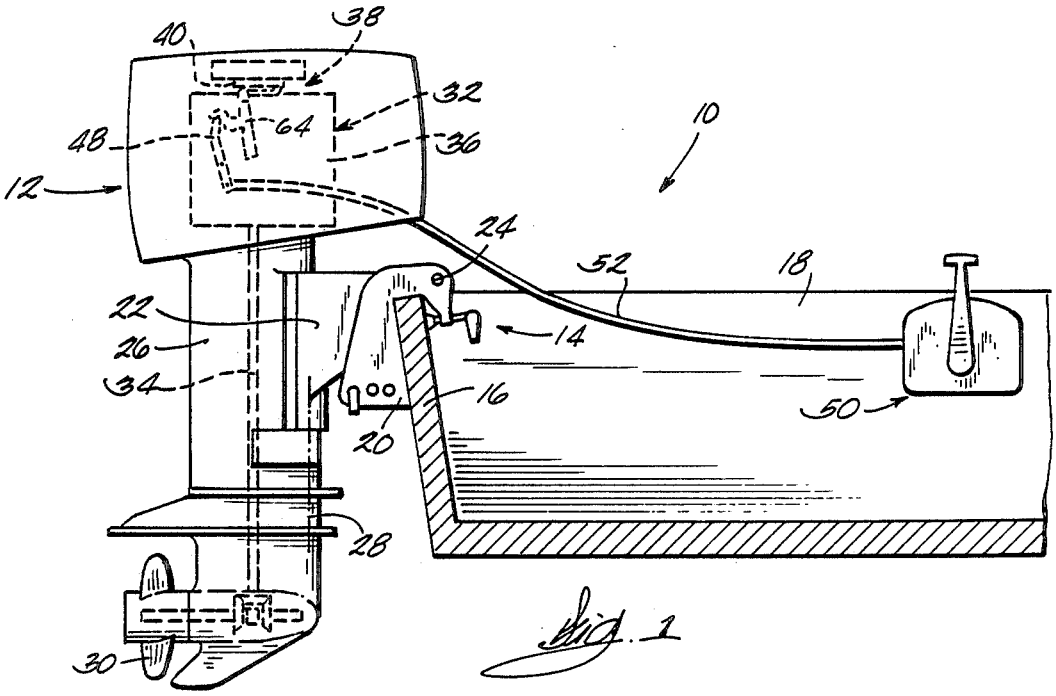
FIG. 1 is a fragmentary side elevational view, partially in section, of a marine installation embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine installation 10 embodying the invention is shown in FIG. 1. The marine installation 10 comprises a marine propulsion device which is preferably in the form of an outboard motor 12. In alternative embodiments, the marine propulsion device could be a stern drive unit.

The outboard motor 12 comprises a mounting assembly 14 releasably mounted on the transom 16 of a boat 18. While various suitable mounting assemblies can be employed, in the illustrated construction, the mounting assembly 14 includes a transom bracket 20 fixedly mounted on the transom 16, and a swivel bracket 22 mounted on the transom bracket 20 for pivotal movement relative thereto about a generally horizontal tilt axis 24. The outboard motor 12 further comprises a propulsion unit 26 mounted on the swivel bracket 22 for pivotal movement relative thereto about a generally vertical steering axis 28. The propulsion unit 26 includes a rotatably mounted propeller 30, and an engine 32 drivingly connected to the propeller 30 by a conventional drive train 34.

Figure 2:
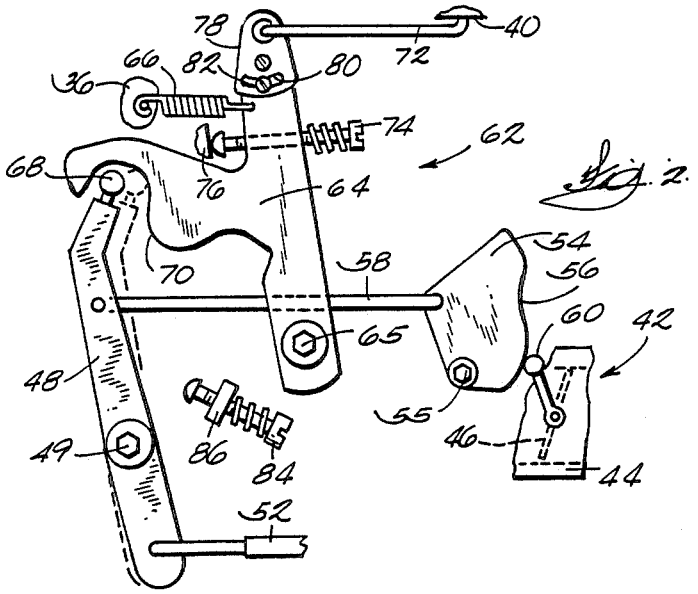
FIG. 2 is an enlarged, fragmentary side elevational view of the engine of the marine installation.
Figure 3:
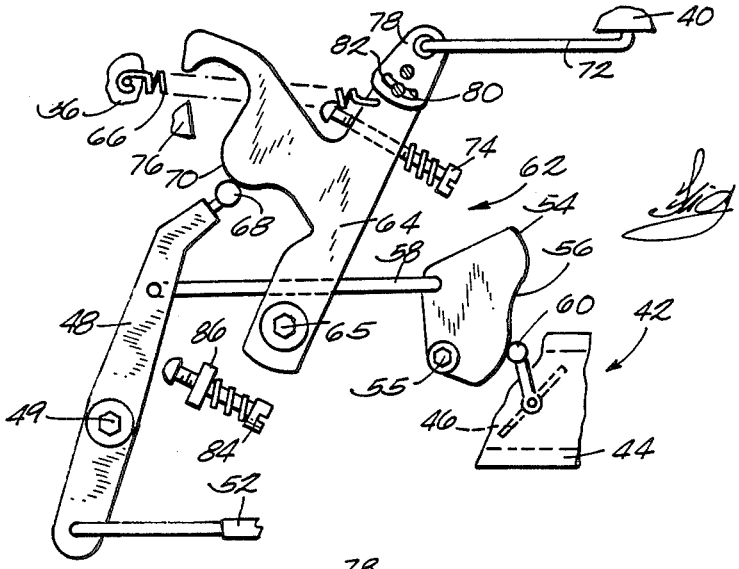
FIG. 3 is a view similar to FIG. 2 and showing the control lever in the second intermediate position.
Figure 4:
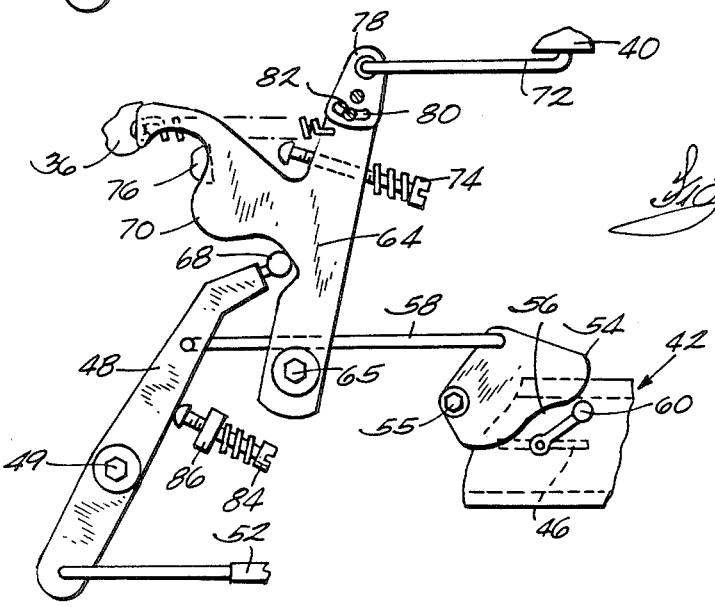
FIG. 4 is a view similar to FIG. 2 and showing the control lever in the full speed position.

The engine 32 comprises an engine block 36, and an ignition system (not shown) which is preferably a capacitor discharge system and which includes one or more trigger coils (not shown) carried by a spark timing control mechanism 38 including a timer base 40. The timer base 40 is supported by the engine block 36 for rotary movement in opposite directions between a minimum spark advance position or setting in which the spark advance is at a minimum (and is preferably retarded approximately five degrees), a maximum spark advance position or setting in which the spark advance is at a maximum (preferably advanced approximately 30 degrees), and an intermediate spark advance position or setting between the minimum and maximum spark advance settings (preferably advanced approximately 18 degrees). As shown in FIGS. 2–4, spark advance occurs in response to left-to-right movement of the timer base 40 and spark retard occurs in response to right-to-left movement of the timer base 40. Other spark timing mechanisms, including electronic mechanisms, can be employed.

The engine 32 also comprises (see FIGS. 2–4) a fuel supply mechanism 42. While various suitable fuel supply mechanisms can be employed, including fuel injection mechanisms, in the preferred embodiment, the fuel supply mechanism 42 comprises one or more carburetors 44 which are supported by the engine block 36 and which include respective throttles or valve plates 46 which are movable between an idle or closed throttle setting (shown in FIG. 2) and a full speed or wide-open throttle setting (shown in FIG. 4).

The engine 32 further comprises a control lever 48 supported by the engine block 36 for rotary movement about an axis 49 and between an idle position (shown in solid lines in FIG. 2), a full speed or wide-open throttle position (FIG. 4), a first intermediate position (shown in dotted lines in FIG. 2) between the idle position and the full speed position, and a second intermediate position (FIG. 3) between the first intermediate position and the full speed position. Pivotal movement of the control lever 48 is controlled by a remote control mechanism 50 which is mounted on the boat 18, which is connected to the control lever 48 by a push-pull cable 52 to cause pivotal movement of the control lever 48 in response to operation of the remote control mechanism 50, and which constitutes operator actuatable means for moving the control lever 48.

The engine 32 also comprises means for displacing the fuel supply mechanism 42 from the idle setting to the full speed setting in response to movement of the control lever 48 from the idle position to the full speed position. While various suitable means can be employed, in the preferred embodiment, such means includes a throttle lever 54 supported by the engine block 36 for pivotal movement about an axis 55 and having thereon a cam surface 56, means in the form of a link 58 for rotating the throttle lever 54 in response to rotation of the control lever 48, and roller means 60 engaging the cam surface 56 for displacing the fuel supply mechanism 42, i.e., for rotating the valve plate 46, in response to rotation of the throttle lever 54 Such means for displacing a fuel supply mechanism in response to rotation of a control lever is conventional.

The engine 32 further comprises spark timing control means 62 for permitting movement of the control lever 48 from the idle position to the first intermediate position without displacing the spark timing mechanism 38 from the minimum spark advance setting, for displacing the spark timing mechanism 38 from the minimum spark advance setting to the maximum spark advance setting in response to movement of the control lever 48 from the first intermediate position to the second intermediate position, and for displacing the spark timing mechanism 38 from the maximum spark advance setting to the intermediate spark advance setting in response to movement of the control lever 48 from the second intermediate position to the full speed position. While various suitable control means can be used, in the illustrated construction, the spark timing control means 62 includes a spark lever 64 supported by the engine block 36 for pivotal movement about an axis 65 and between a minimum position (FIG. 2), a maximum position (FIG. 4), and an intermediate position (FIG. 3) between the minimum position and the maximum position, and means for biasing the spark lever 64 to the minimum position. While various suitable biasing means can be used, in the preferred embodiment, the biasing means includes a spring 66 extending between the engine block 36 and the spark lever 64. In alternative embodiments, the biasing means can act directly on the spark timing mechanism 38 rather than on the spark lever 64.

The spark timing control mean 62 also includes a roller 68 rotatably mounted on the control lever 48, and, on the spark lever 64, a cam surface 70 which engages the roller 68 when the control lever 48 is between the first intermediate position and the full speed position. Preferably, as shown in FIG. 2, the cam surface 70 is out of engagement with the roller 68 when the control lever 48 is between the idle position and the first intermediate position. The cam surface 70 has a shape such that the spark lever 64 moves from the minimum position to the maximum position in response to movement of the control lever 48 from the first intermediate position to the second intermediate position, and moves from the maximum position to the intermediate position in response to movement of the control lever 48 from the second intermediate position to the full speed position. The spark timing control means 62 also includes means in the form of a link 72 connecting the spark lever 64 to the timer base 40 for displacing the spark timing mechanism 38 to the minimum spark advance setting in response to movement of the spark lever 64 to the minimum position, for displacing the spark timing mechanism 38 to the intermediate spark advance setting in response to movement of the spark lever 64 to the intermediate position, and for displacing the spark timing mechanism 38 to the maximum spark advance setting in response to movement of the spark lever 64 to the maximum position.

Because the cam surface 70 is out of engagement with the roller 68 when the control lever 48 is between the idle position and the first intermediate position, the spark lever 64, which is biased to the minimum position, remains in the minimum position while the control lever 48 moves from the idle position to the first intermediate position. In alternative embodiments, the cam surface 70 can have a dwell portion which is a constant distance from the control lever axis 49 when the spark lever 64 is in the minimum position, and which engages the roller 68 when the control lever 48 is between the idle position and the first intermediate position.

The engine 32 preferably further comprises means for limiting displacement of the spark timing mechanism 38 in the direction toward the minimum spark advance setting. While various suitable means can be used, in the illustrated construction, such means includes means for limiting movement of the spark lever 64 in the direction toward the minimum position. In the illustrated construction, as shown in FIG. 2, this means includes a screw 74 which is adjustably fixed relative to the spark lever 64 and which engages a stop 76 on the engine block 36.

The engine 32 preferably further comprises means for adjusting the setting of the spark timing mechanism 38 relative to the position of the spark lever 64. While various suitable means can be employed, in the preferred embodiment, this means includes (see FIGS. 2–4) an adjustment member 78 which is pivotally mounted on the upper end of the spark lever 64 and to which the link 72 is connected. The adjustment member 78 has therein a slot 80, and a screw 82 extends through the slot 80 and threadedly engages the spark lever 64. When the screw 82 is tightened, the position of the adjustment member 78 relative to the spark lever 64 is fixed, and thus the setting of the spark timing mechanism 38 relative to the position of the spark lever 64 is fixed. This arrangement for adjusting the setting of a spark timing mechanism relative to the position of a spark lever is conventional.

The engine 32 further comprises means for limiting movement of the control lever 48 in the direction toward the full speed position. While various suitable means can be used, in the illustrated construction, such means includes a screw 84 which is threaded into a boss 86 on the engine block 36 and which engages the control lever 48 for limiting movement of the control lever 48 in the direction toward the full speed position. This is shown in FIG. 4. This arrangement for limiting movement of a control lever is conventional.

Operation of the spark timing control means 62 is illustrated in FIGS. 2–4. When the control lever 48 is in the idle position, as shown in solid lines in FIG. 2, the spark lever 64 is biased to the minimum position and the cam surface 70 is out of engagement with the roller 68. When the control lever 48 moves to the first intermediate position, as shown in dotted lines in FIG. 2, the spark lever 64 remains in the minimum position and the roller 68 does not engage the cam surface 70 until the control lever 48 reaches the first intermediate position. When the control lever 48 moves to the second intermediate position, as shown in FIG. 3, engagement of the cam surface 70 by the roller 68 causes the spark lever 64 to move from the minimum position to the maximum position. When the control lever 48 moves from the second intermediate position to the full speed position, as shown in FIG. 4, engagement of the cam surface 70 by the roller 68 causes the spark lever 64 to move from the maximum position to the intermediate position.

Figure 5:
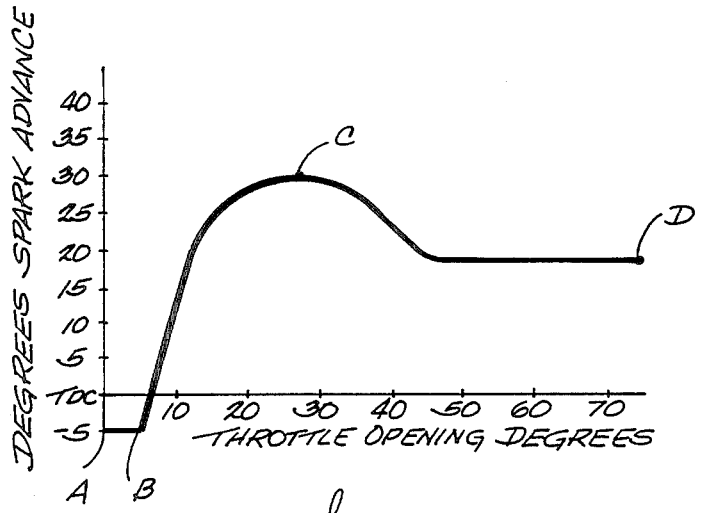
FIG. 5 is a graph showing the relationship of the spark timing mechanism setting to the fuel supply mechanism setting.

The resultant relationship of the spark timing mechanism setting to the fuel supply mechanism setting is illustrated in FIG. 5. Points A, B, C and D are the points at which the control lever 48 is in the idle, first intermediate, second intermediate and full speed settings, respectively. As shown in FIG. 5, the spark timing remains at minimum advance (actually retarded or negative advance) while the control lever 48 moves from the idle position to the first intermediate position, advances to maximum advance while the control lever 48 moves from the first intermediate position to the second intermediate position, and is retarded to an intermediate advance while the control lever 48 moves from the second intermediate position to the full speed position.

Various features of the invention are set forth in the following claims.

We claim:

1. A marine propulsion device comprising a propulsion unit including a rotatably mounted propeller, and an engine drivingly connected to said propeller and comprising an engine block, a spark timing mechanism operable between a minimum spark advance setting and a maximum spark advance setting, a fuel supply mechanism operable between an idle setting and a full speed setting, a control lever supported by said engine block for movement between an idle position, a full speed position, a first intermediate position between said idle position and said full speed position, and a second intermediate position between said first intermediate position and said full speed position, means for displacing said fuel supply mechanism from said idle setting to said full speed setting in response to movement of said control lever from said idle position to said full speed position, and spark timing control means for permitting movement of said control lever from said idle position to said first intermediate position without displacing said spark timing mechanism from said minimum spark advance setting, for displacing said spark timing mechanism from said minimum spark advance setting to said maximum spark advance setting in response to movement of said control lever from said first intermediate position to said second intermediate position, and for displacing said spark timing mechanism from said maximum spark advance setting toward said minimum spark advance setting in response to movement of said control lever from said second intermediate position to said full speed position.

2. A marine propulsion device comprising a propulsion unit including a rotatably mounted propeller, and an engine drivingly connected to said propeller and comprising an engine block, a spark timing mechanism operable between a minimum spark advance setting, a maximum spark advance setting, and an intermediate spark advance setting between said minimum spark advance setting and said maximum spark advance setting, a fuel supply mechanism operable between an idle setting and a full speed setting, a control lever supported by said engine block for movement between an idle position, a full speed position, a first intermediate position between said idle position and said full speed position, and a second intermediate position between said first intermediate position and said full speed position, means for displacing said fuel supply mechanism from said idle setting to said full speed setting in response to movement of said control lever from said idle position to said full speed position, and spark timing control means for permitting movement of said control lever from said idle position to said first intermediate position without displacing said spark timing mechanism from said minimum spark advance setting, for displacing said spark timing mechanism from said minimum spark advance setting to said maximum spark advance setting in response to movement of said control lever from said first intermediate position to said second intermediate position, and for displacing said spark timing mechanism from said maximum spark advance setting to said intermediate spark advance setting in response to movement of said control lever from said second intermediate position to said full speed position.

3. A marine propulsion device as set forth in claim 2 wherein said spark timing control means includes cam and roller means.

4. A marine propulsion device as set forth in claim 3 wherein said cam and roller means includes a spark lever supported by said engine block for movement between a minimum position, a maximum position, and an intermediate position between said minimum position and said maximum position, means for biasing said spark lever to said minimum position, means for displacing said spark timing mechanism to said minimum spark advance setting in response to movement of said spark lever to said minimum position, for displacing said spark timing mechanism to said intermediate spark advance setting in response to movement of said spark lever to said intermediate position, and for displacing said spark timing mechanism to said maximum spark advance setting in response to movement of said spark lever to said maximum position, a roller on one of said control lever and said spark lever, and a cam surface on the other of said control lever and said spark lever, said cam surface engaging said roller when said control lever is between said first intermediate position and said full speed position, and said cam surface having a shape such that said spark lever moves from said minimum position to said maximum position in response to movement of said control lever from said first intermediate position to said second intermediate position, and moves from said maximum position to said intermediate position in response to movement of said control lever from said second intermediate position to said full speed position.

5. A marine propulsion device as set forth in claim 4 wherein said roller is on said control lever and said cam surface is on said spark lever.

6. A marine propulsion device as set forth in claim 4 and further comprising means for limiting movement of said spark lever in the direction toward said minimum position.

7. A marine propulsion device as set forth in claim 4 and further comprising means for adjusting the setting of said spark timing mechanism relative to the position of said spark lever.

8. A marine propulsion device as set forth in claim 4 wherein said cam surface is out of engagement with said roller when said control lever is between said idle position and said first intermediate position.

9. A marine propulsion device as set forth in claim 2 wherein said means for displacing said fuel supply mechanism includes a throttle lever having thereon a cam surface, means for rotating said throttle lever in response to rotation of said control lever, and roller means engaging said cam surface for displacing said fuel supply mechanism in response to rotation of said throttle lever.

10. A marine propulsion device as set forth in claim 2 and further comprising means for limiting movement of said control lever in the direction toward said full speed position.

11. A marine propulsion device as set forth in claim 2 and further comprising means for limiting displacement of said spark timing mechanism in the direction toward said minimum spark advance setting.

12. An engine comprising an engine block, a spark timing mechanism operable between a minimum spark advance setting and a maximum spark advance setting, a fuel supply mechanism operable between an idle setting and a full speed setting, a control lever supported by said engine block for movement between an idle position, a full speed position, a first intermediate position between said idle position and said full speed position, and a second intermediate position between said first intermediate position and said full speed position, means for displacing said fuel supply mechanism from said idle setting to said full speed setting in response to movement of said control lever from said idle position to said full speed position, and spark timing control means for permitting movement of said control lever from said idle position to said first intermediate position without displacing said spark timing mechanism from said minimum spark advance setting, for displacing said spark timing mechanism from said minimum spark advance setting to said maximum spark advance setting in response to movement of said control lever from said first intermediate position to said second intermediate position, and for displacing said spark timing mechanism from said maximum spark advance setting toward said minimum spark advance setting in response to movement of said control lever from said second intermediate position to said full speed position.

13. An engine comprising an engine block, a spark timing mechanism operable between a minimum spark advance setting, a maximum spark advance setting, and an intermediate spark advance setting between said minimum spark advance setting and said maximum spark advance setting, a fuel supply mechanism operable between an idle setting and a full speed setting, a control lever supported by said engine block for movement between an idle position, a full speed position, a first intermediate position between said idle position and said full speed position, and a second intermediate position between said first intermediate position and said full speed position, means for displacing said fuel supply mechanism from said idle setting to said full speed setting in response to movement of said control lever from said idle position to said full speed position, and spark timing control means for permitting movement of said control lever from said idle position to said first intermediate position without displacing said spark timing mechanism from said minimum spark advance setting, for displacing said spark timing mechanism from said minimum spark advance setting to said maximum spark advance setting in response to movement of said control lever from said first intermediate position to said second intermediate position, and for displacing said spark timing mechanism from said maximum spark advance setting to said intermediate spark advance setting in response to movement of said control lever from said second intermediate position to said full speed position.

14. An engine as set forth in claim 13 wherein said spark timing control means includes cam and roller means.

15. An engine as set forth in claim 14 wherein said cam and roller means includes a spark lever supported by said engine block for movement between a minimum position, a maximum position, snd an intermediate position between said minimum position and said maximum position, means for biasing said spark lever to said minimum position, means for displacing said spark timing mechanism to said minimum spark advance setting in response to movement of said spark lever to said minimum position, for displacing said spark timing mechanism to said intermediate spark advance setting in response to movement of said spark lever to said intermediate position, and for displacing said spark timing mechanism to said maximum spark advance setting in response to movement of said spark lever to said maximum position, a roller on one of said control lever and said spark lever, and a cam surface on the other of said control lever and said spark lever, said cam surface engaging said roller when said control lever is between said first intermediate position and said full speed position, and said cam surface having a shape such that said spark lever moves from said minimum position to said maximum position in response to movement of said control lever from said first intermediate position to said second intermediate position, and moves from said maximum position to said intermediate position in response to movement of said control lever from said second intermediate position to said full speed position.

16. An engine as set forth in claim 15 wherein said roller is on said control lever and said cam surface is on said spark lever.

17. An engine as set forth in claim 14 wherein said cam surface is out of engagement with said roller when said control lever is between said idle position and said first intermediate position.

18. An engine as set forth in claim 14 and further comprising means for limiting movement of said spark lever in the direction toward said minimum position.

19. An engine as set forth in claim 14 and further comprising means for adjusting the setting of said spark timing mechanism relative to the position of said spark lever.

20. An engine as set forth in claim 13 wherein said means for displacing said fuel supply mechanism includes a throttle lever having thereon a cam surface, means for rotating said throttle lever in response to rotation of said control lever, and roller means engaging said cam surface for displacing said fuel supply mechanism in response to rotation of said throttle lever.

21. An engine as set forth in claim 13 and further comprising means for limiting movement of said control lever in the direction toward said full speed position.

22. An engine as set forth in claim 13 and further comprising means for limiting displacement of said spark timing mechanism in the direction toward said minimum spark advance setting.

* * * * *